US005566999A

United States Patent [19]

Goettl

[11] Patent Number: 5,566,999

[45] Date of Patent: Oct. 22, 1996

[54] DIFFERENTIAL HOIST FIXTURE

[76] Inventor: David R. Goettl, 729 Illinois St., Sheridan, Wyo. 82801

[21] Appl. No.: 319,068

[22] Filed: Oct. 6, 1994

[51] Int. Cl.[6] ..... B66C 1/42

[52] U.S. Cl. ..... 294/103.1; 294/92

[58] Field of Search ..... 294/103.1, 92, 294/101, 82.1, 67.21, 67.22, 901

[56] References Cited

U.S. PATENT DOCUMENTS

| | | | |
|---|---|---|---|
| 2,542,289 | 2/1951 | Robbins . | |
| 2,636,770 | 4/1953 | Cornwell | 294/103.1 |
| 2,652,278 | 9/1953 | Allen . | |
| 2,693,386 | 11/1954 | Renfroe . | |
| 2,764,447 | 9/1956 | Schmidt . | |
| 3,008,750 | 11/1961 | Wansley | 294/92 |
| 3,362,684 | 1/1968 | Davenport | 294/92 |
| 3,958,825 | 5/1976 | Diamond | 294/92 |
| 4,850,630 | 7/1989 | Davies . | |

FOREIGN PATENT DOCUMENTS

| | | |
|---|---|---|
| 1481756 | 3/1969 | Germany . |
| 581061 | 10/1976 | Switzerland . |

*Primary Examiner*—Dean Kramer
*Attorney, Agent, or Firm*—Richard C. Litman

[57] ABSTRACT

A differential hoist fixture is adapted to secure to the flange of a differential case to provide for the lifting thereof, as in rear axle differentials used in large over the road trucks, mining equipment, and other large industrial wheeled vehicles. The fixture includes two parallel jaws, with one including a clamping bolt therethrough, and a lifting arm at right angles to the two jaws. The clamping bolt may be inwardly angled in the jaw opening, so that as the differential is lifted, the tendency for the flange to slip from the jaw opening will tend to cock the clamping bolt outward, thus applying further clamping force. The opposite jaw may include inwardly angled teeth on the inner surface, facing the clamping bolt, for greater security. The attachment to the lifting arm may be adjustable, by a plurality of bolt holes or an elongated slot for the lifting bolt. The adjustability of the lifting bolt attachment enables the lifting force to be applied substantially over the center of gravity of the differential, thus providing for ease of alignment during reassembly.

19 Claims, 2 Drawing Sheets

DIFFERENTIAL HOIST FIXTURE

FIELD OF THE INVENTION

The present invention relates generally to tools and fixtures providing for the grasping, clamping, and/or lifting of heavy objects, and more specifically to a specialized fixture adapted to be secured to the flange of a case half of a heavy duty differential for the lifting or hoisting thereof, particularly for positioning the differential for assembly and installation.

BACKGROUND OF THE INVENTION

Motor vehicles, particularly large over-the-road trucks and other wheeled equipment used in mining and other heavy industrial applications, utilize various extremely large and heavy mechanical components. While such components (i.e., engines, transmissions, differentials, etc.) generally tend to be extremely durable due to their massive construction, they nevertheless must be removed from the vehicle from time to time for maintenance or repair.

The handling of such components requires mechanical or power assistance, duet the weight and bulk of such articles. While some of these components lend themselves to lifting or hoisting with mechanical or hydraulic hoists (e.g., many engines provide for the bolting lifting loops or eyes to the block or head), other components an be difficult to move and maneuver, due to the lack of provision of lifting attachment points. While a lifting attachment may be secured to some points (e.g., existing bolt holes or the like) of some of these components, the attachment point is generally not on the center of gravity of the component, making it difficult to maneuver into the desired position.

In the case of axle differentials in heavy duty vehicles and equipment, the standard means used to lift and maneuver such devices is to weld a lifting eye or loop (e.g., a chain link) to the exterior of the case over the approximate center of gravity thereof, to provide for the attachment of a sling or hoist thereto. While such a procedure enables the differential to be lifted, several disadvantages are apparent using such a technique. First of all, the localized melting of the metal of the case during the welding operation can weaken the case at that point, or at least introduce localized thermal stress in the case at that point, possibly leading to a crack or fracture of the case at some later time. Secondly, since there are numerous different models and types of differentials in use, it can be difficult to install the lifting eye over the precise center of gravity of the differential, unless the mechanic is highly experienced and knows the precise characteristics of the various differentials with which he is working. Finally the welding of a link to the differential case is a relatively time consuming operation, in that the welding equipment must be obtained, the weld made, and the completed weld allowed to cool somewhat before further handling takes place. The relatively thick metal of the case requires a relatively large welding tip (for gas welding) or high amperage (for electric arc), resulting in a large amount of heat released.

Accordingly, the need arises for a differential hoist fixture providing for attachment to an existing differential case without need for modification thereof. The fixture must provide means for positive clamping to the case to preclude slippage therefrom, and must also provide for adjustment to allow for different centers of gravity of different types of differentials.

DESCRIPTION OF THE PRIOR ART

U.S. Pat. No. 2,542,289 issued to Ollice C. Robbins on Feb. 20, 1951 discloses a Beam Hook having an open, diagonally disposed jaw when disposed in an operable position. The jaw provides for the insertion of one side of one flange of a T-section or I beam therein, whereupon a pair of set screws is adjusted to bear against the inner side of the flange. The weight of the beam web causes the outer surface of the flange to bear against the outer edge of the opposite side of the jaw from the set screws as the beam is displaced from its longitudinal center of gravity. The set screws do not positively clamp the beam flange within the jaw, as provided by the present invention, and the diagonally disposed jaw of the Robbins hook precludes its use on a generally vertically disposed flange, is essential in the environment of the present invention.

U.S. Pat. No. 2,652,278 issued to David A. Allen on Sep. 15, 1952 discloses a Building Block Lift including a jaw with a handle extending therefrom, the jaw being temporarily installable about one side wall of an open celled concrete block or the like for the lifting and maneuvering thereof. The block is held in place with in the jaw by the diagonal disposition of the jaw and resultant tilling of the block in the jaw so as to cause the block to twist about its center of gravity; no set screws or other positive clamping means are used. The result is similar to that described above in the Robbins hook device, and thus neither can be used for the hoisting or lifting of an article by a flange which must be held in a substantially vertical position in order to provide for installation of the article, as in the present invention.

U.S. Pat. No. 2,693,386 issued to Raymond L. Renfroe on Nov. 2, 1954 discloses a Beam Clamp having the general configuration of a C-clamp, with a threaded bolt or the like being advanced to clamp an article between the end of the bolt and the opposite jaw. The lifting swivel for the assembly is disposed about the upper end of the bolt, rather than on the clamp body, unlike the present invention, thus allowing the swivel to rotate about the bolt, unlike the fixed link used in the present invention. The Renfroe device is thus incapable of holding an article in a fixed position relative to the center of gravity of the article, as in the present fixture.

U.S. Pat. No. 2,764,447 issued to Edward C. Schmidt, Jr. on Sep. 25, 1956 discloses a Lifting Device for barrels, drums and the like comprising a generally L-shaped arm having an upper jaw which clamps to the upper rim of the drum, and a lower brace which rests against the side of the drum. the upper jaw includes a threaded screw wherein, but the screw is offset from the opposite upper jaw members, rather than being directly opposite one of the members, as in the present invention. Moreover, the lifting point is at a 90 degree angle from the drum contact points, thus causing the drum to be angularly displaced when lifted, unlike the aligned lifting provided by the present fixture.

U.S. Pat. No. 4,850,630 issued to William Davies on Jul. 25, 1989 disclose a Clamp With Movable Jaw Structure comprising a generally C-clampilike device having spherically movable opposed members in the jaw and the clamping end of the screw. The device provides for even clamping action of objects having non-parallel opposite faces, land is thus beyond the scope of the present invention.

West German Patent No. 1,481,756 to Hubert Waltermann and published on Mar. 13, 1969 discloses a Lifting Clamp comprising a C-clamp configuration with a lifting eye through the body of the clamp. The clamp screw is offset from the opposite jaw, resulting in asymmetrical 1Dads being placed on an object clamped therein, unlike the present clamp. The lifting eye is essentially over the jaw, with no offset providing for non-alignment of the center of gravity of the object, as provided for by the present fixture.

Finally, Swiss Patent No. 581,061 to Joseph Dunnand and published on Oct. 29, 1976 discloses a Carrying Handle For Flower Pot comprising a U-shaped handle portion with the opposite ends of the U serving as jaw members, and a transverse member welded therebetween including a central screw therethrough, which serves as the single opposite jaw member. The screw end is offset from the two ends is of the U-shaped portion, and cannot apply clamping pressure directly opposite the ends of the U. The lifting handle is considerably offset from the center of the article being lifted, thus precluding the maintenance of any alignment with the center of gravity of the object or article. The relatively lightweight rod members used in the formation of the U-shaped member are not suitable for lifting heavy loads, as required in the environment of the present fixture.

None of the above noted patents, taken either singly or in combination, are seen to disclose the specific arrangement of concepts disclosed by the present invention.

SUMMARY OF THE INVENTION

By the present invention, an improved differential hoist fixture is disclosed.

Accordingly, one of the objects of the present invention is to provide an improved differential hoist fixture which is adapted to provide for attachment to the flange of a differential case half as used in industrial vehicles and the like.

Another of the objects of the present invention is to provide an improved differential hoist fixture which includes a lifting end which is offset from the clamping jaws of the fixture, to provide for the lifting of a differential to which the fixture is secured, on a line substantially through the center of gravity of the differential.

Yet another of the objects of the present invention is to provide an improved differential hoist fixture which includes an inwardly offset clamping screw, thereby producing a wedging effect when the fixture is secured to a differential flange and lifting force is applied to the fixture and differential.

Still another of the objects of the present invention is to provide an improved differential hoist fixture which includes plural lifting points or an adjustable lifting point, thereby providing for the repositioning of the lifting point to allow for different centers of gravity of different types of differentials.

A further object of the present invention is to provide an improved differential hoist fixture which jaw opposite the clamping bolt is adapted to be placed between differential case halves during their initial assembly, to allow the starting of the case bolts therebetween while the present fixture is still secured to one case half.

An additional object of the present invention is to provide an improved differential hoist fixture which is of durable construction, preferably being forged or formed of tool steel, steel plate, or be r stock or the like.

A final object of the present invention is to provide an improved differential hoist fixture for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the figures of the attached drawings.

DETAILED DESCRIPTION OF THE PREFERRED EMBODIMENTS

Figure 2:
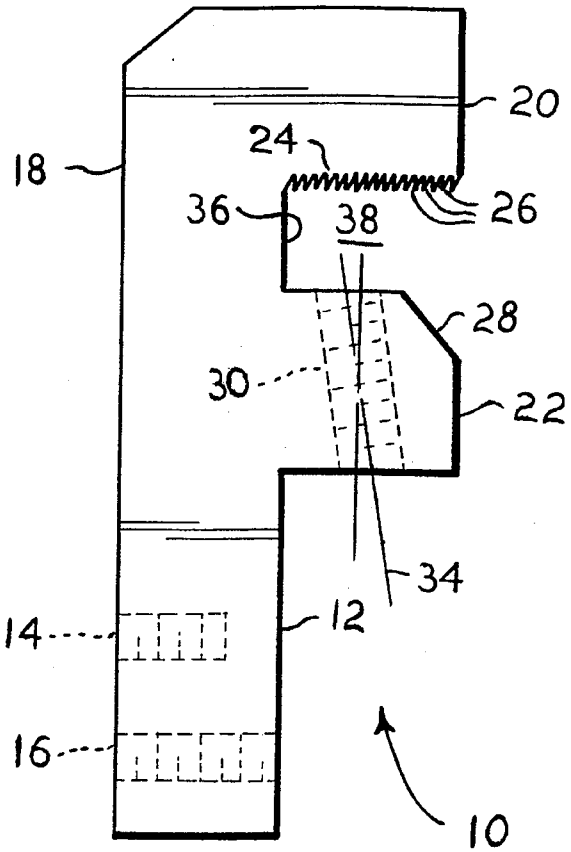
FIG. 2 is a side view of the present fixture, showing its various features and details.
Figure 1:
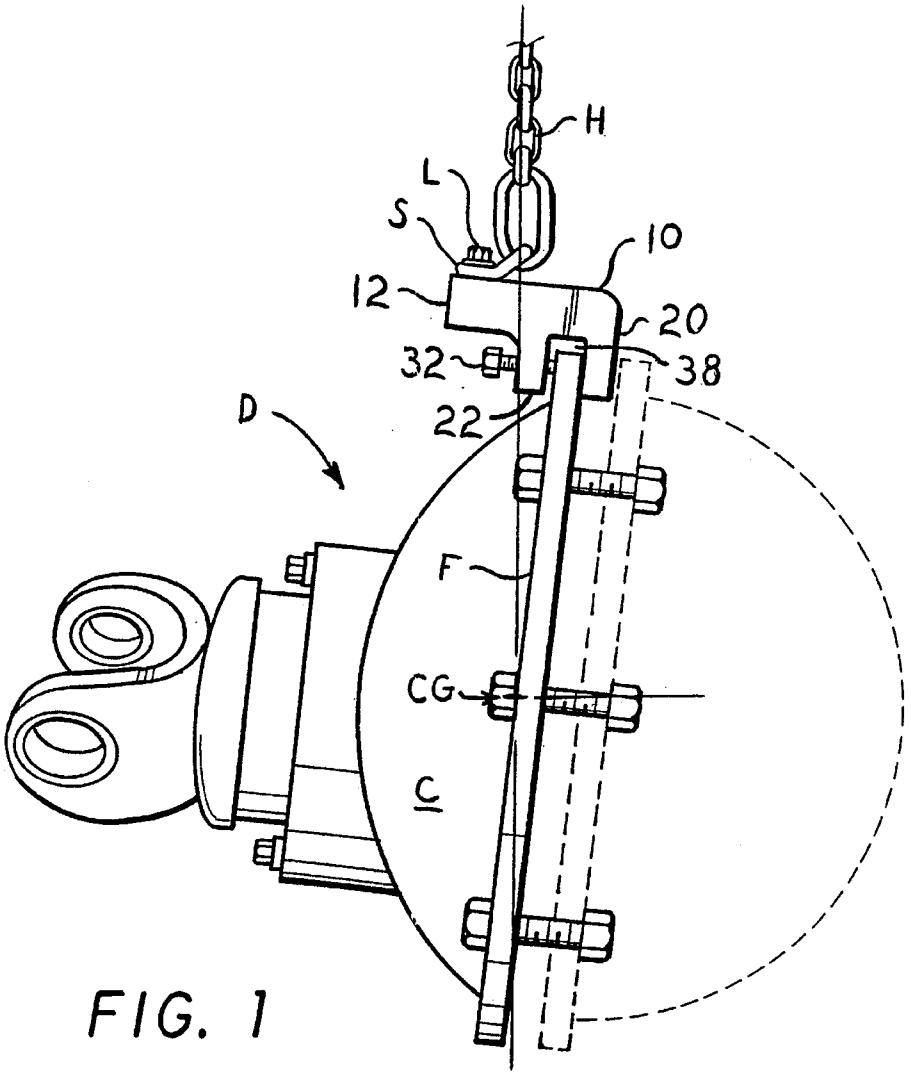
FIG. 1 is a side view of the present fixture secured to the flange of a differential case half, showing the offset nature of the lifting eye to provide lifting force substantially in alignment with the center of gravity of the differential and allowing the case halves to be initially assembled with the fixture in place.

Referring now particularly to FIGS. 1 and 2 of the drawings, the present invention will be seen to relate to a differential hoist fixture 10 providing for attachment to and hoisting of a large motor vehicle differential D, as used in over the road trucks, mining equipment, and other large industrial wheeled vehicles. Heretofore, it has been standard practice to weld a lifting eye E to the differential case C, as shown in the prior art FIG. 4, in order to lift the differential D while maintaining its alignment for the installation thereof to the mating case half. Generally, the differential flange F is not equipped with bolt holes at the upper center of the flange, resulting in the differential D being axially displaced if a bolt is passed through one of the flange holes and used as a lifting means. Moreover, the differential flange F is generally rearwardly located relative to the center of gravity of the differential D, resulting in the differential D tilting forward if it is lifted from directly above the flange F. The effect of lifting the differential by a flange bolt hole is to tilt the differential D axially (i.e., angularly about the drive shaft input) and forwardly, making it extremely difficult to align the differential D with its mating case half.

FIG. 2 provides a detailed view of a first embodiment of the present different al hoist fixture 10. Fixture 10 includes a lifting arm 12, including at least one threaded bolt passage or hole 14 therethrough or therein; in the case of the fixture 10 of FIG. 2, plural holes 14 and 16 are provided, which holes 14 and 16 are displaced i tom the grasping end of the fixture 10 in order to provide lifting force substantially over the center of gravity of the differential 1, as shown in FIG. 1.

A clamp end 18 of the fixture 10 is provided at the opposite end of the lifting arm 12, with the clamp end 18 including fixed first and second jaws 20 and 22 extending at substantially right angles therefrom. The distal first jaw 20 includes an inwardly facing surface 24 having a plurality of teeth 26 formed thereon, providing for the gripping of one side of the differential flange F. The opposite second jaw 22 includes a chamfered corner or relief 28 providing clearance for any flange reinforcing web on the differential. A threaded bolt hole 30 is also provided through the second jaw 22, providing for the installation of a bolt 32 therein (FIG. 1), which bolt 32 may be advanced to clamp the flange F between the end of the bolt 32 and the first jaw teeth 26.

The threaded bolt hole 30 will be seen in FIG. 2 to be angularly offset, with the bolt hole axis 34 angled inwardly toward the back surface 36 of the opening 38 between the two jaws 20 and 22. This angular offset provides additional clamping security when the present fixture 10 is secured to a differential flange F, as the weight of the differential will cause the differential flange F to slip from the jaw opening 38 unless sufficient clamping force is applied to the flange F. By angling the bolt hole 30 (and a bolt 32 installed therein) inwardly toward the back of the jaw opening 38, the withdrawing force will tend to cock the bolt 32 slightly sideways in the hole 30 due to the slight play between the bolt 32 and the bolt it hole 30, causing the end of the bolt 32 which is in contact with the differential flange F to grip the flange F more firmly, in the manner of the jaw of a pipe wrench or the like, although on a much reduced scale. This slight misalingnment of the bolt 32 in its hole 30 insures even greater gripping strength for the present fixture 10.

Figure 3:
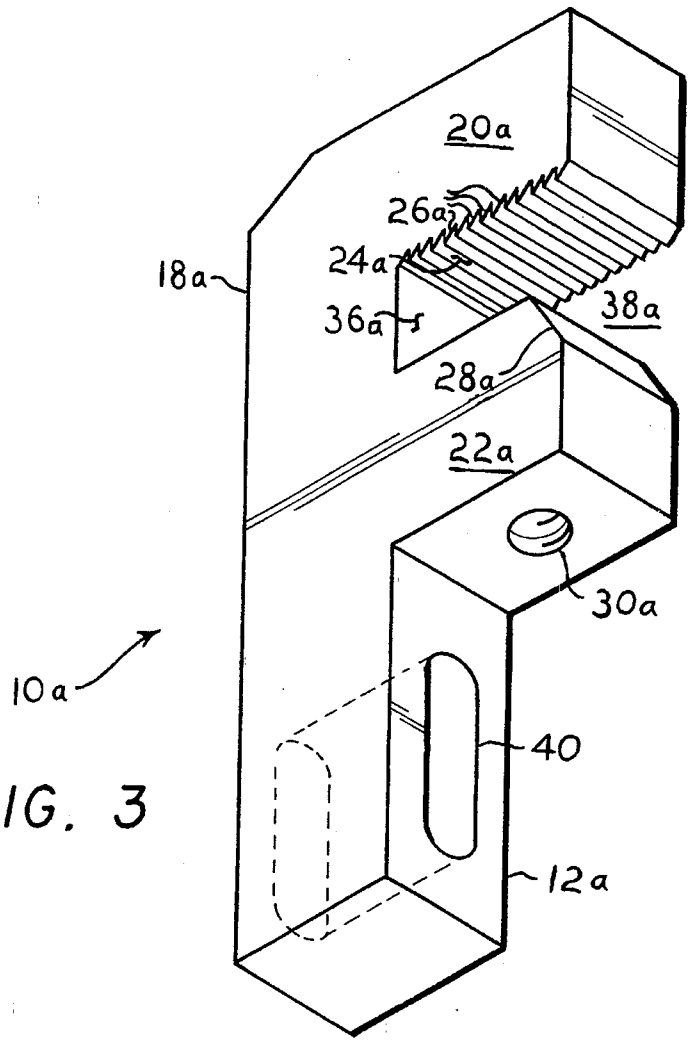
FIG. 3 is a perspective view of an alternate embodiment of the present fixture, showing a slotted lifting eye attachment hole.

FIG. 3 provides a perspective view of an alternate embodiment comprising a differential hoist fixture 10*a*, generally having the same configuration as the differential hoist 10 discussed in data above. Fixture 10*a* includes a lifting arm 12*a*, clamp end 18*a*, first and second jaws 20*a* and 22*a*, with the first jaw inner surface 24*a* including a plurality of teeth 26*a* thereon, a chamfered corner/relief 28*a* on the second jaw 22*a*, an angularly offset threaded clamping bolt hole 30*a* through the second jaw 22*a*, with the jaws 20*a* and 22*a* including an opening 38*a* therebetween and the opening 38*a* having a back surface 36*a*.

Figure 4:
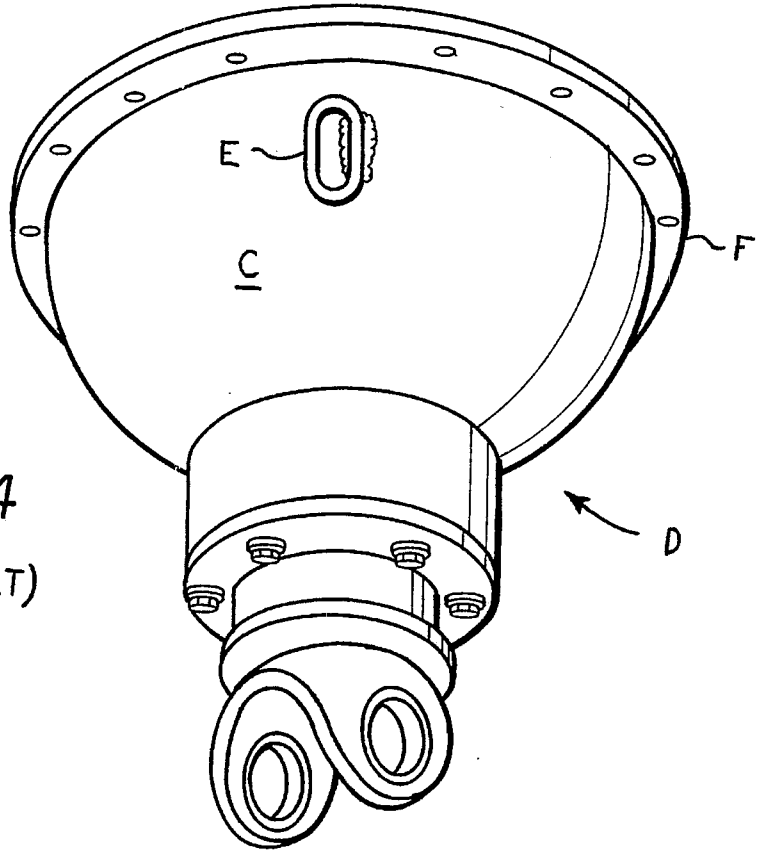
FIG. 4 (PRIOR ART)
FIG. 4 is a perspective view of the prior art means of lifting or hoisting a differential, by means of a lifting eye welded in place or the case half.

However, the second embodiment fixture 10*a* of FIG. 3 provides a different lift attachment means than the plural lifting attachment holes 14 and 16 of the first embodiment fixture 10, in that an elongated slot 40 has been provided through the lifting arm 12*a* of the fixture 10*a* of FIG. 4. The slot 40 may be used to provide a wider range of lifting positions for the fixture 10*a* than the relatively few bolt holes 16 and 18 of the fixture 10, thus allowing finer adjustment of the center of gravity of a differential hoisted by the fixture 10*a*. However, it may be preferable in some instances to provide only a relatively few distinct bolt holes or passages, in order to preclude the possibility of longitudinal slippage of a bolt within such an elongated slot 40.

A compromise alternative (not shown) is possible, in which a plurality of over lapping holes are formed through the lifting arm portion of the fixture. Such a configuration would preclude slippage of a bolt between holes due to the curved side walls of the holes, but would provide greater adjustability due to the overlapping of the holes.

The above described fixtures 10 or 10*a* are used to lift large and heavy truck differentials D and the like, by fitting the jaw opening 38/38*a* over the flange F of a case half of the differential D, and tightening the clamping bolt 32 in the second jaw hole 30/30*a*. The lifting end 12/12*a* is positioned over the approximate center of gravity CG of the differential D before tightening the clamping bolt. With the fixture 10/10*a* secured to the differential flange F, the lifting or hoist chain H may be secured, using means such as the shackle S, to one of the plural lifting holes 14 or 16 of the fixture lifting arm 12, or alternatively through the elongated slot 40 of the lifting arm 12*a* of the fixture 10, and adjusted as desired. It will be noted that the first lifting hole 14 of the fixture 10 is blind, i.e., does not pass completely through the lifting arm 12. The threads of the hole 16, engaging a properly sized threaded lifting bolt L, provide sufficient security. However, the hole may be formed and threaded completely through the lifting arm 12 if desired, as in the lifting hole 16. If the hole is formed completely through the arm 12, it may be left unthreaded and an appropriate nut (not shown) used to secure the opposite end of tie bolt through the arm 12, in the manner used to secure a bolt through the slot 40 of the fixture 10*a* of FIG. 3.

As the differential D is lifted, the angularly offset clamping bolt hole 30/30*a* through the second jaw 22/22*a* will tend to cock sideways in the hole 30/30*a*, with the end of the bolt 32 in contact with the flange F being cocked outwardly in the jaw opening 38/38*a*. This action, in combination with the inwardly angled teeth 26/26*a* of the upper jaw 20/20*a*, provides additional gripping strength as the fixture 10/10*a* lifted with the differential flange F secured therein.

The differential D may then be maneuvered or repositioned as desired for maintenance or repair. When the differential D is to be reinstalled on the vehicle or to the vehicle axle, it may be positioned as desired, with the case flange F in close contact with its mating flange shown in broken lines in FIG. 1). The first jaw 20/20*a* of the fixture 10/10*a* is adapted to fit between the two flanges while the flange bolts are installed, with the first jaw 20/20*a* not exceeding a thickness which would preclude being able to start the nuts on the ends of the bolts.

Once the differential case assembly has been started and the flange bolts are engaged through the case halves, the second jaw clamping bolt 32 may be loosened and the fixture 10/10*a* removed from the differential flange F to allow completion of the differential assembly. The lifting bolt L may be removed, and the fixture 10/10*a* stored for reuse. The durable material used in the construction of the present fixture 10/10*a* (e.g., forged as a single piece or machined from a single unitary block of bar stock, plate, or tool steel, etc.) provide the required durability to ensure reliable gripping strength and minimal wear on bolt hole threads and/or jaw teeth, thus providing a lifting fixture 10/10*a* which will pay for itself many times over through the elimination of the need for welding and/or other less than optimal means of lifting and hoisting large differentials for maintenance and repair.

It is to be understood that the present invention is not limited to the sole embodiments described above, but encompasses any and all embodiments within the scope of the following claims.

I claim:

1. A differential hoist fixture comprising:

a clamping end comprising a fixed first jaw having an inner surface and a fixed second jaw substantially parallel to said first jaw and spaced apart therefrom to form a jaw opening therebetween, with said clamping end having a lifting arm extending therefrom and disposed at substantially right angles to said first jaw and said second jaw;

said second jaw including a threaded clamping bolt hole formed therethrough, with said clamping bolt hole having an axis in the plane of said first jaw and said second jaw;

said lifting arm including lifting bolt attachment means therein, adapted for the attachment of a lifting bolt thereto and providing for said lifting bolt to pass through said lifting arm substantially parallel to said first jaw and said second jaw;

a clamping bolt threadedly installed within said clamping bolt hole and serving to clamp a differential flange between said first jaw and said second jaw when said clamping bolt is tightened, with said first jaw and said second jaw adapted to fit over the flange of a differential and to secure the flange therebetween, whereby;

said clamping end of said fixture is affixed to a differential flange by means of said clamping bolt threadedly advanced against the flange to secure the flange between said first jaw and said second jaw and against said inner surface of said first jaw, and said differential hoist fixture is secured to a hoist means by means of a lifting bolt secured to said lifting bolt attachment means of said lifting arm, to provide for the lifting of the differential by the differential flange.

2. The differential hoist fixture of claim 1 including:

a plurality of teeth formed on said inner surface of said first jaw, with said teeth providing additional gripping strength on a differential flange inserted in said jaw opening and secured therein by said clamping bolt.

3. The differential hoist fixture of claim 2 wherein:

said first jaw and said second jaw include a rear surface therebetween defining the back of said jaw opening, and said teeth are rearwardly angled within said jaw opening toward said rear surface.

4. The differential hoist fixture of claim 1 wherein:

said first jaw and said second jaw include a rear surface therebetween defining the back of said jaw opening, and said clamping bolt hole axis is rearwardly inclined through said second jaw and toward said rear surface of the back of said jaw opening.

5. The differential hoist fixture of claim 1 including:

a relief on said second jaw adjacent said jaw opening, providing clearance for a differential flange reinforcement web.

6. The differential hoist fixture of claim 1 wherein:

said lifting bolt attachment means provides for the adjustable attachment of said lifting bolt to said lifting arm.

7. The differential hoist fixture of claim 1 wherein:

said first jaw, said second jaw, said clamping end, and said lifting arm are monolithically formed as a single unitary piece.

8. A differential hoist fixture comprising:

a clamping end comprising a fixed first jaw having an inner surface and a fixed second jaw substantially parallel to said first jaw and spaced apart therefrom to form a jaw opening therebetween, with said clamping end having a lifting arm extending therefrom and disposed at substantially right angles to said first jaw and said second jaw;

said second jaw including a threaded clamping bolt hole formed therethrough, with said clamping bolt hole having an axis in the plane of said first jaw and said second jaw;

said lifting arm including a plurality of lifting bolt attachment holes therein, each adapted for the attachment of a lifting bolt thereto and providing for said lifting bolt to extend into said lifting arm substantially parallel to said first jaw and said second jaw;

a clamping bolt threadedly installed within said clamping bolt hole and serving to clamp a differential flange between said first jaw and said second jaw when said clamping bolt is tightened, with said first jaw and said second jaw adapted to fit over the flange of a differential and to secure the flange therebetween, whereby;

said clamping end of said fixture is affixed to a differential flange by means of said clamping bolt threadedly advanced against the flange to secure the flange between said first jaw and said second jaw and against said inner surface of said first jaw, and said differential hoist fixture is secured to a hoist means by means of a lifting bolt secured to one of said lifting bolt attachment holes of said lifting arm and substantially over the center of gravity of the differential, to provide for the lifting of the differential by the differential flange.

9. The differential hoist fixture of claim 8 including:

a plurality of teeth formed on said inner surface of said first jaw, with said teeth providing additional gripping strength on a differential flange inserted in said jaw opening and secured therein by said clamping bolt.

10. The differential hoist fixture of claim 9 wherein:

said first jaw and said second jaw include a rear surface therebetween defining the back of said jaw opening, and said teeth are rearwardly angled within said jaw opening toward said rear surface.

11. The differential hoist fixture of claim 8 wherein:

said first jaw and said second jaw include a rear surface therebetween defining the back of said jaw opening, and said clamping bolt hole axis is rearwardly inclined through said second jaw and toward said rear surface of the back of said jaw opening.

12. The differential hoist fixture of claim 8 including:

a relief on said second jaw adjacent said jaw opening, providing clearance for a differential flange reinforcement web.

13. The differential hoist fixture of claim 8 wherein:

said first said second jaw, said clamping end, and said lifting arm are monolithically formed as a single unitary piece.

14. A differential hoist fixture comprising:

a clamping end comprising a fixed first jaw having an inner surface and a fixed second jaw substantially parallel to said first jaw and spaced apart therefrom to form a jaw opening therebetween, with said clamping end having a lifting arm extending therefrom and disposed at substantially right angles to said first jaw and said second jaw;

said second jaw including a threaded clamping bolt hole formed therethrough, with said clamping bolt hole having an axis in the plane of said first jaw and said second jaw;

said lifting arm including an elongated lifting bolt attachment slot therein, adapted for the adjustable attachment of a lifting bolt thereto and providing for said lifting bolt to pass through said lifting arm substantially parallel to said first jaw and said second jaw;

a clamping bolt threadedly installed within said clamping bolt hole and serving to clamp a differential flange between said first jaw and said second jaw when said clamping bolt is tightened, with said first jaw and said second jaw adapted to fit over the flange of a differential and to secure the flange therebetween, whereby;

said clamping end of said fixture is affixed to a differential flange by means of said clamping bolt threadedly advanced against the flange to secure the flange between said first jaw and said second jaw and against said inner surface of said first jaw, and said differential hoist fixture is adjustably secured to a hoist means by means of a lifting bolt secured through said elongated lifting bolt attachment slot of said lifting arm and substantially over the center of gravity of the differential, to provide for the lifting of the differential by the differential flange.

15. The differential hoist fixture of claim 14 including:

a plurality of teeth formed on said inner surface of said first jaw, with said teeth providing additional gripping strength on a differential flange inserted in said jaw opening and secured therein by said clamping bolt.

16. The differential hoist fixture of claim 15 wherein:

said first jaw and said second jaw include a rear surface therebetween defining the back of said jaw opening, and said teeth are rearwardly angled within said jaw opening toward said rear surface.

17. The differential hoist fixture of claim 15 wherein:

said first jaw and said second jaw include a rear surface therebetween defining the back of said jaw opening, and said clamping bolt hole axis is rearwardly inclined through said second jaw and toward said rear surface of the back of said jaw opening.

18. The differential hoist fixture of claim 15 including:

a relief on said second jaw adjacent said jaw opening, providing clearance for differential flange reinforcement web.

19. The differential hoist fixture of claim 15 wherein:

said first jaw, said second jaw, said clamping end, and said lifting arm are monolithically formed as a single unitary piece.

* * * * *